United States Patent [19]

Lilley

[11] Patent Number: 4,986,251

[45] Date of Patent: Jan. 22, 1991

[54] AIRGUN MAGAZINE

[75] Inventor: Stephen J. Lilley, Sawston, England

[73] Assignee: Utec B. V., Driebergen, Netherlands

[21] Appl. No.: 348,257

[22] Filed: May 5, 1989

[30] Foreign Application Priority Data

May 6, 1988 [GB] United Kingdom ..... 8810674.5

[51] Int. Cl.[5] ..... F41B 11/00

[52] U.S. Cl. ..... 124/67; 124/48; 124/52

[58] Field of Search ..... 124/63–68, 124/48, 45, 51 R, 52, 53

[56] References Cited

U.S. PATENT DOCUMENTS

| | | | |
|---|---|---|---|
| 926,546 | 6/1909 | Cox | 124/48 |
| 1,328,929 | 1/1920 | McDaniel | 124/48 X |
| 1,677,810 | 7/1928 | Bond | 124/51 R |
| 1,816,091 | 7/1931 | Schmeisser | 124/48 |
| 2,303,017 | 11/1942 | Brown et al. | 124/52 |
| 2,609,811 | 9/1952 | Lawrence | 124/48 |
| 2,713,859 | 7/1955 | Bradfield | 124/45 |
| 3,818,887 | 6/1974 | Akiyama et al. | 124/67 |
| 3,913,553 | 10/1975 | Braughler et al. | 124/48 X |
| 4,850,328 | 7/1989 | Sindel | 124/52 X |

FOREIGN PATENT DOCUMENTS

| | | | |
|---|---|---|---|
| 3040924 | 5/1982 | Fed. Rep. of Germany | 124/45 |
| 4622 | of 1906 | United Kingdom | 124/48 |

OTHER PUBLICATIONS

"Gas, Air and Spring Guns", W. H. B. Smith, 1957, pp. 146–147.

*Primary Examiner*—Peter M. Cuomo
*Assistant Examiner*—Jeffrey L. Thompson
*Attorney, Agent, or Firm*—Lee, Mann, Smith, McWilliams & Sweeney

[57] ABSTRACT

A magazine for an air gun comprises an outer case, a circular pellet carrier rotatably mounted in the outer case, and a cover that is pivotally mounted on the outer case. A coil spring resiliently biases the pellet carrier towards an end position. To load the magazine, the cover is pivoted to cause the pellet carrier to rotate to another end position, and a soft lead airgun pellet is then dropped in through a hole in the outer cover into a pellet chamber in the pellet carrier. The outer cover is then rotated, allowing successive pellets to be dropped into successive pellet chambers within the pellet carrier. In use, a probe pushes the first pellet out of the magazine into the breech of an airgun, and following this, the magazine automatically indexes under spring pressure to present the next pellet ready for loading. The pellets themselves serve as part of the indexing mechanism. The transfer probe places the pellets accurately in position within the breech of the airgun.

27 Claims, 7 Drawing Sheets

AIRGUN MAGAZINE

This invention relates to pellet magazines for airguns.

Conventional waisted "diabolo" airgun pellets are made out of soft lead and are therefore susceptible to damage. Such pellets are very small as well as soft. It is therefore very easy to drop them when loading them individually into the breech of an airgun, which is a considerable inconvenience, especially when out in the field. An effective and reliable magazine would overcome these problems and reduce the shot-to-shot time, even if the pellets were not dropped. It would become even more useful if it did not make the airgun any larger, more awkward to use or more likely to snag on clothes or undergrowth. If it were compact and readily removable, so that it did not have to be loaded with pellets in situ and thus spare, pre-loaded magazines could be carried in a pocket and fitted rapidly and easily as required; and if it could operate reliably with a wide range of different pellet weights and lengths, then yet further important advantages would have been achieved.

There have been many attempts to provide versatile and reliable magazine facilities on airguns. One of the oldest and best-documented examples is the gravity-fed, tube magazines for spherical balls developed by Girardoni of Austria primarily for military air-rifles at the end of the 18th century.

The rapid development of the airgun as a high-volume consumer product from the latter half of the 19th century onwards was accompanied by many further attempts to provide effective magazines. U.S. Pat. No. 94,279 of 1869 to Bunge, U.K. Patent No. 4622 of 1906 to Butler, U.K. Patent No. 4824 of 1907 to Cox, U.K. Patent No. 302,279 of 1930 to Schmeisser, U.K. Patent No. 685,700 of 1949 to Lawrence and German Patent No. 876370 of 1953 to Walther are examples of attempts using rotary, drum or disc systems.

The Walther magazine shown in German Patent No. 876370 is perhaps of particular interest in that it is compact, circular, removable and spring-loaded. Unfortunately it is incapable of handling diabolo pellets; if diabolo pellets are to be used, the magazine must be removed, a blanking device fitted and each diabolo pellet must then be manually inserted in the breech in turn.

It is notable that in "Smith's Standard Encyclopedia of Gas, Air and Spring Guns of the World" of 1957, still widely regarded as a major reference work, it is stated on page 244:

> "Repeating Models. In two specimens (referring to HY-SCORE repeating pistols) tested, these did not work too well on feeding. Judging by the manufacturer's instructions which accompanied the pistols, other also have had trouble with consistent feeding. This must always be expected in ANY repeating mechanism using a fragile, shaped, thin-skirted pellet of the Diabolo design. The Author has used several air pistols and rifles with very efficient feed systems, both gravity and spring types, for loading ball-type ammunition. With the sole exception of the complicated and fragile slide system once used by Crosman rifles, no repeating system examined has been found even reasonably reliable for feeding Diabolos."

Thirty years later the position had changed little and John Walter, a world authority on airguns, wrote in 1984, in "The Airgun Book", Third Edition, on page 24:

> "The quest for an ideal magazine will continue, as much development is still to be done. Unfortunately, the malleability of lead pellets prevents any spring-powered feed—though the advent of tough, synthetic body pellets such as Promethus may change matters."

In addition to rotary, drum or disc configurations, many inventors have also used slide systems and, more commonly, tube magazines, often spring-loaded. Spring-loaded tube magazines can be made to function with a high degree of reliability with spherical ball ammunition and with moderate reliability with selected Diabolo pellets. If pellets of varying lengths and/or head shapes are used, however, the chances of complete malfunction and/or deformation of the pellet, usually during the transfer from the end of the tube into the breech, rise very significantly. In addition it is very difficult for tube magazines to be readily removeable which, if it could be done, would conveniently enable pre-loaded spare magazines to be carried.

Preferred embodiments of the present invention aim to overcome the abovementioned difficulties with airgun magazines. They have been found to be both simple and extremely reliable, having been used for thousands of shots without a single malfunction. Advantages have been found to include the following:

they can be loaded with either or both ball, diabolo or other pellets of a calibre to suit the airgun and are substantially insensitive to the shape or length of the pellets;

they may ensure that pellets can be fed directly into the breech and engaged in the rifling without distortion or damage;

they may be extremely compact and easily removed or inserted; and they may enable a user to ascertain rapidly whether any pellets are left, without removing the magazine.

More generally, according to a first aspect of the present invention, there is provided an airgun magazine comprising:

a pellet carrier having a plurality of chambers each for receiving a respective airgun pellet;

a housing in which the pellet carrier is moveably mounted; and means for causing movement of the pellet carrier in the housing to present successive pellets in the pellet chambers to the breech of an airgun when the pellet carrier is fitted in the airgun.

At least the pellet carrier may be adapted to be detachable from an airgun in which the magazine may be used. Preferably, the magazine is detachable as a complete exchangeable unit from an airgun in which the magazine may be used.

Said housing is preferably provided with registration means adapted to co-operate with corresponding registration means provided on an airgun to ensure consistent registration of the magazine with the breech of the airgun when the magazine is fitted in the airgun.

Preferably, each pellet chamber is of at least part-cylindrical configuration.

The magazine preferably includes a cover which co-operates with the pellet carrier to retain the pellets therein and which is provided with at least one loading aperture through which pellets may be loaded into the pellet chambers.

Such a cover may be moveable with respect to the housing and/or pellet carrier, so that the cover may be placed into successive positions to permit loading of successive ones of the pellet chambers.

The magazine preferably includes indexing means for so controlling movement of the pellet carrier in the housing as to ensure registration of the successive pellet chambers with the breech of the airgun, in use, the indexing means including an abutment surface which is arranged to abut each successive pellet in the pellet carrier so as to ensure registration of that pellet with the breech of the airgun.

The arrangement may be such that, when said abutment surface abuts a respective one of the pellets, the pellet reacts the force applied at the abutment surface at at least two points on the pellet carrier.

Preferably, said abutment surface is of a part-circular configuration of a radius substantially corresponding to that of the pellets to be received in the magazine.

The abutment surface may be provided on a projection which extends into the pellet carrier and the pellet carrier may be provided with a slot which extends through the pellet chambers and which passes around said projection as the pellet carrier moves relative to the housing. Said projection may be provided on said housing.

Preferably, each pellet chamber has a diameter slightly greater than that of the pellets with which the magazine is intended to be used, the arrangement being such that the pellet that is in a position ready to be loaded into the breech is retained in its chamber at least partly by abutment with said abutment surface, and each other pellet is retained in its chamber by co-operation between the pellet carrier and housing or by co-operation between the pellet carrier, housing and cover.

The magazine preferably includes resilient biassing means for biassing the pellet carrier towards an end position within said housing.

The pellet carrier may advantageously be of a circular configuration, arranged for angular movement within said housing.

Alternatively, the pellet carrier may be of a straight configuration, arranged for rectilinear movement within said housing.

Said housing may be provided with an exit hole which in use registers with the breech of the airgun, and through which pellets are passed from the pellet carrier and into the breech.

The invention extends also to an airgun provided with a magazine in accordance with the first aspect of the invention.

In a second aspect, the invention provides an airgun comprising:

a magazine for containing a plurality of pellets;

means for presenting the pellets successively adjacent the breech of the airgun; and transfer means for transferring into the breech each pellet that is presented adjacent the breech, the transfer means comprising a probe that is arranged to extend through the magazine to push the respective pellet out of the magazine and into a predetermined position within the breech.

Preferably, the forward end of the probe cooperates with the mouth of the breech to provide a gas-tight seal when the probe places a pellet in said predetermined position within said breech.

Advantageously, said forward end of the probe and the mouth of the breech may be correspondingly chamfered to provide interengaging surfaces which provide said gas-tight seal.

Preferably, the magazine is arranged to grip at least the pellet that is presented adjacent the breech, and the probe is arranged to release said grip as it extends through the magazine to push the pellet into the breech.

The probe may be arranged to release said grip by co-operating with the pellet carrier to move the pellet carrier by a small amount, as the probe extends through the magazine.

In an airgun in accordance with the second aspect of the invention, the magazine may be in accordance with the first aspect of the invention.

The probe may be arranged to be withdrawn automatically through the magazine after firing of the airgun, thereby to cause or permit the magazine to index to present the next pellet adjacent the breech.

The probe may be arranged to be extended automatically through the magazine each time the magazine has been indexed, so as to push the next pellet into the breech.

The probe may be hollow to define an air passage through which, in use, air passes to propel a pellet out of the gun.

For a better understanding of the invention and to show how the same may be carried into effect, reference will now be made, by way of example, to the accompanying diagrammatic drawings, in which.

In the figures, like reference numerals denote like or corresponding parts.

Figure 1:
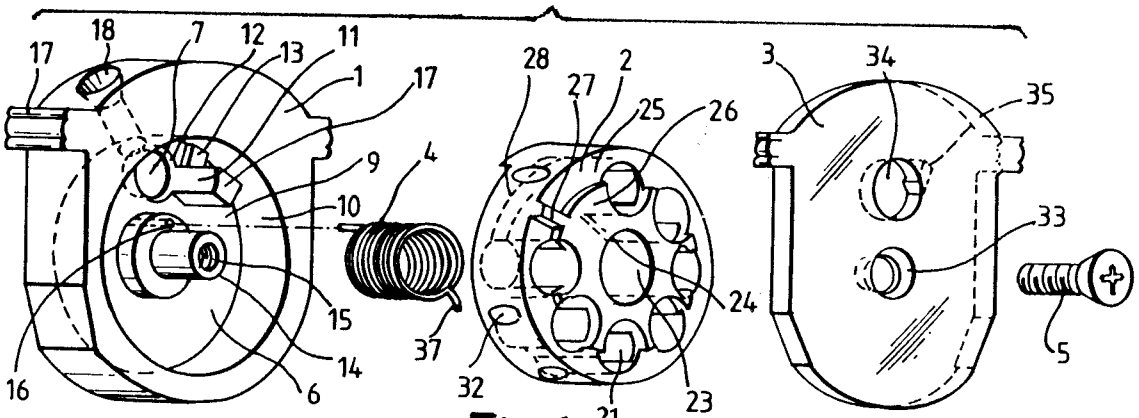
FIGS. 1 and 2 are exploded views of a circular magazine.
Figure 2:
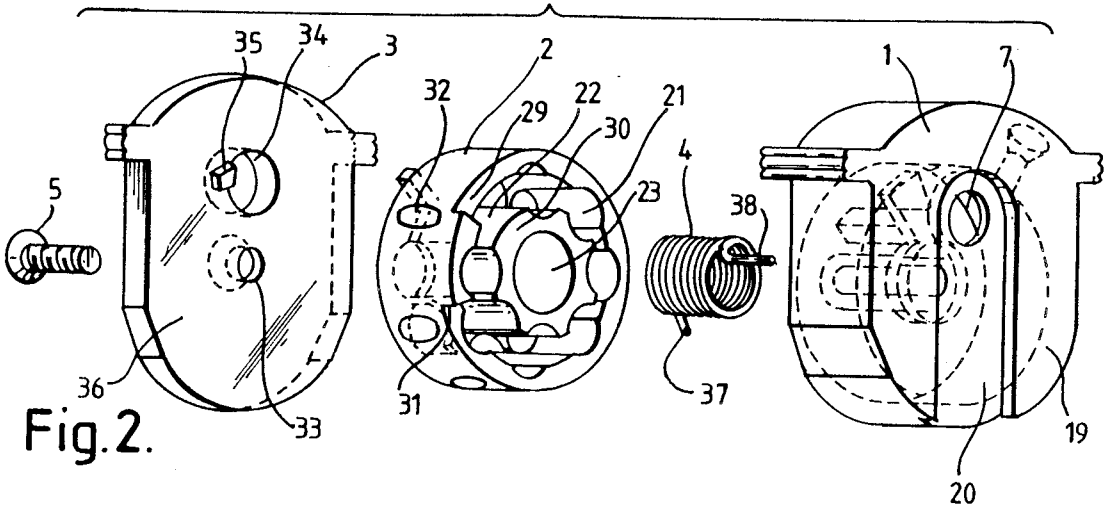

A preferred magazine configuration is shown in FIGS. 1 and 2 and consists of a housing in the form of an outer case 1, an inner pellet carrier 2, a transparent cover plate 3, a coil spring 4 and a combined fixing screw/pivot 5.

The outer case 1 has a circular recess 6, an exit hole 7 for the pellets, an integral pellet stop post 8 extending from the base 9 of the recess 6, spaced from the wall 10 of the recess 6 with one vertical face 11 of the pellet stop post 8 curved and aligned to match the adjacent edge 12 of the exit hole 7. An integral raised ridge 13 on the base 9 of the recess 6 is located between the post 8 and the adjacent wall 10.

A further integral circular post 14 is located in the centre of the recess 6 and has a blind hole 15 at its top to receive the fixing screw 5. In a shoulder at the base of the post 14 is a small hole 16 to receive one end of the spring 4. Lugs 17 provide a convenient grip and a viewing hole 18 passes through to the inner recess wall 10. On the face 19 of the case 1 is formed a shallow recess 20, open at one end.

The inner pellet carrier 2 has a series of chambers 21 to receive pellets, and each of the chambers 21 is of part cylindrical configuration. An annular slot or channel 22 passes through the chambers 21, and is just high enough and wide enough to receive the post 8 without interference. The pellet carrier 2 is further formed with a central hole 23 with a small radially extending hole 24 off it, and an annular recess 25 on the edge of an end face 26 which terminates in a narrow spur 27 extending to the outer side 28. A similar annular recess 29 extends around the outer edge of the opposite end face 30 and ends in a narrow spur 31. Around the side 28 are provided a series of sequential numbers and/or markings 32, one adjacent to each chamber 21.

The transparent cover plate 3 has an outline corresponding to that of the outer case 1, a countersunk central hole 33, a large, curved hole 34 and a stud 35 on an inside face 36, adjacent to the hole 34.

The coil spring 4 has one end 37 perpendicular to its principal axis and the other end 38 parallel to it.

The screw/pivot 5 is a countersunk, self-tapping screw.

The magazine is assembled as follows;

The spring 4 is inserted in the hole 23 in the pellet carrier 2 with its end 37 engaged in the small hole 24. The pellet carrier 2 is then fitted in the recess 6 of the case 1 so that the central post 14 passes through the spring 4 and the end 38 of the spring enters the small hole 16. The carrier 2 is rotated anti-clockwise against spring pressure so that the spur 31 passes over the ridge 13 and is then held against the ridge 13 by spring pressure.

The cover 3 is then mounted on the post 14 using the screw 5 so that it is just able to turn freely and so that its outline is coincident with the outline of the case 1.

Figure 3:
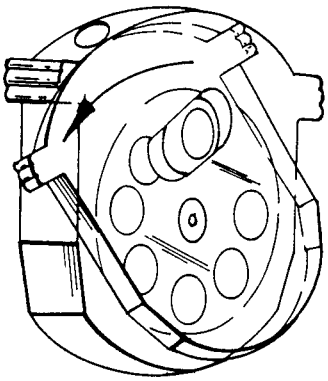
FIGS. 3 and 4 illustrate a loading sequence for the magazine.

The magazine is loaded as shown in FIG. 3. The cover 3 is rotated in an anti-clockwise direction. After a short movement, the stud 35 on the cover 3 engages the spur 27 on the pellet carrier 2 and thus the carrier 2 is rotated with the cover 3, and the spring 4 is wound up. After the pellet carrier 2 has been rotated through nearly 360° its spur 31 abuts the ridge 13 on the case 1 and further rotation is prevented.

Placing a finger over the exit hole 7, a pellet 39 is dropped through the hole 34 in the cover 3, into the chamber 21 which is now in line with the exit hole 7. If the cover plate 3 is now released, the pellet carrier 2 will rotate very slightly clockwise under spring pressure until the pellet 39 is trapped between the walls 40 and 41 of the chamber 21 in the pellet carrier 2 (FIG. 5) and the abutment face 11 of the pellet stop post 8, which will prevent further rotation.

Figure 4:
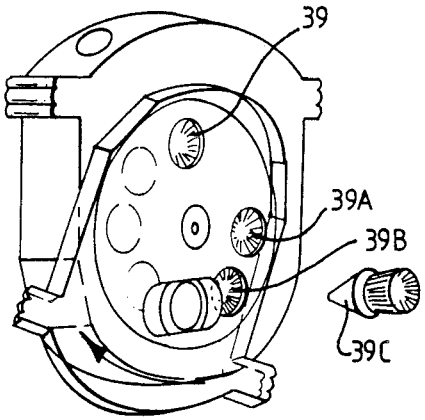

FIG. 4 illustrates how the cover plate 3 is then rotated manually clockwise and further pellets 39A, 39B, 39C etc. are dropped through hole 34 into each successive carrier chamber 21A, 21B, 21C etc. until the required number have been loaded (which may be less than the maximum, if desired). The magazine will then be ready for inserting in the airgun.

Figure 5:
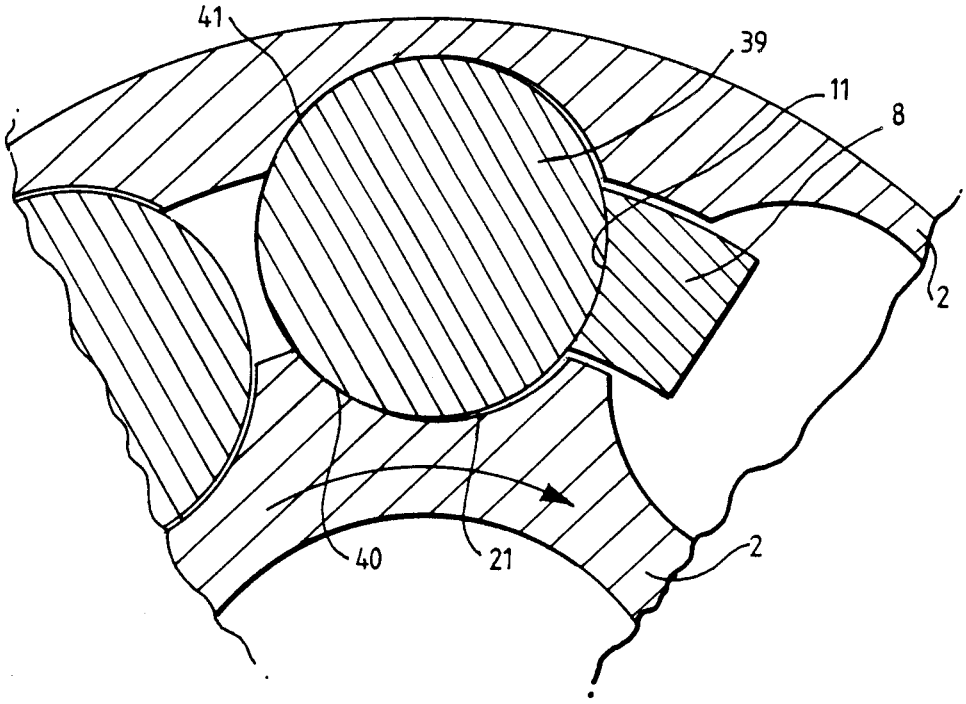
FIG. 5 is a magnified view of part of a section through the loaded magazine.

FIG. 5 is a magnified view of part of a section through the loaded magazine. It shows how the pellet 39, about to be fired, will always be located in exactly the same position, abutting the face 11 of the post 8. It also shows the excellent conformity ratio achieved between the walls 40 and 41 of the chamber 21 and pellet 39, and the abutment face 11 and pellet 39.

Preferably, the radius of the curved abutment face 11 is substantially the same as the maximum diameter of a typical pellet 39, thus producing a near-ideal conformity ratio equal to or very close to 1. As may be seen in FIG. 5, the diameter of the chamber 21 is very slightly greater than that of the pellet 39. The two areas of contact between the walls 40 and 41 of the chamber 21 and the pellet 39 are substantially opposite the abutment face 11, and react the forces transmitted through the pellet 39 from the abutment face 11, which forces are transmitted from the stressed spring 4. Thus, the forces applied to the walls of the pellet 39 in the FIG. 5 position are in a substantially triangular configuration.

By achieving this relatively large and triangulated area of contact, the spring force can be high enough to achieve rapid and reliable feeding and yet, because it is spread over a relatively large surface of the pellet, result in such acceptably low pressures that even a very soft and thin-walled lead diabolo pellet does not get distorted or damaged.

When the pellet 39 is removed, the carrier 2 will rotate clockwise under spring pressure, with the post 8 passing through the channel 22, until the next pellet is brought up against the abutment face 11. It will be appreciated that if, by chance, one chamber 21 has not received a pellet during loading, the carrier 2 will simply continue to rotate until the next full chamber 21 is reached.

As each pellet comes up to the abutment face 11 in turn, the relevant number or marking 32 will become visible through the viewing hole 18. Normally the number visible through hole 18 will indicate the number of chambers remaining to be brought up to the firing position, until the last chamber is reached, when a red or other suitable mark will be visible. Alternatively, only the last one or two chambers may carry an identifying mark.

Figure 6:
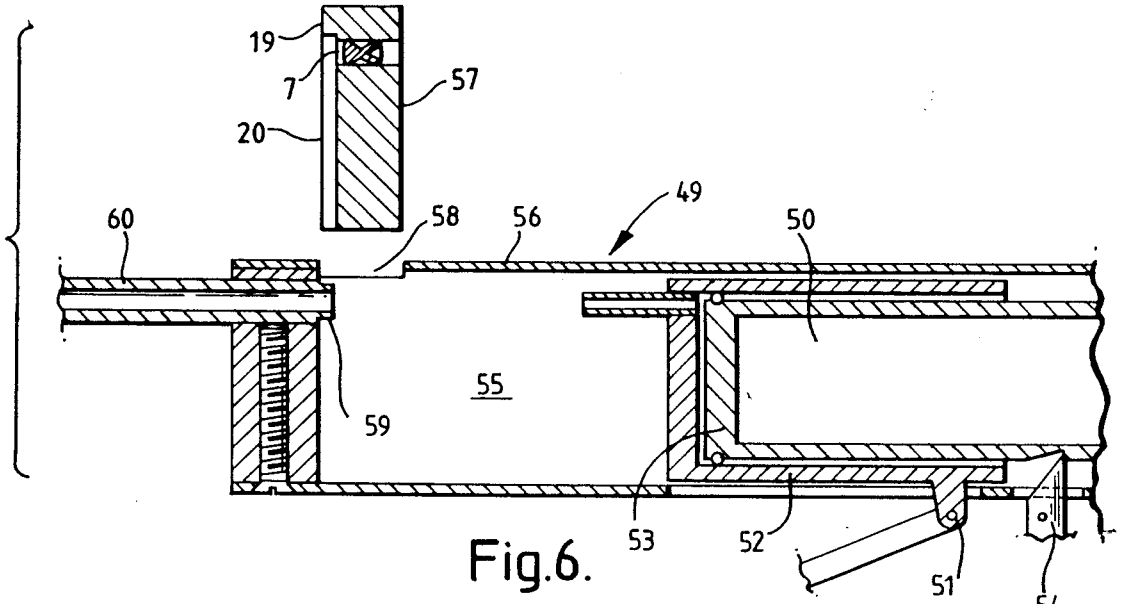
FIGS. 6, 7, 8 and 9 show part of an air rifle in section with a magazine being inserted in a cocked gun which then goes through a sequence of loading and firing.

FIG. 6 shows a sectioned fixed-barrel air-rifle 49 in which the power source is a compressible spring 50, located behind the barrel, which may be a conventional metal coil spring or a sealed gas spring in accordance with U.K. Pat. No. 2,084,704B. In FIG. 6, the spring 50 has been cocked by pressing back a stud 51, attached to a compression cylinder 52, by conventional cocking lever means (omitted for clarity) until the piston 53 is engaged by trigger mechanism 54. By moving the compression cylinder 52 back, a space 55 is exposed within an outer cylinder 56 and a magazine 57 (for example, of the type illustrated in FIGS. 1 to 4) can be inserted into the space 55 through an aperture 58 in the outer cylinder 56.

On the rear face 19 of the magazine 57 is the shallow recess 20, which engages with a correspondingly shaped location guide 59 on the end of the barrel 60. This ensures that the edge 12 of the exit hole 7 of the magazine 57 which is, in effect, a continuation of the abutment face 11, is always accurately aligned with the barrel 60, and in precise register with the breech.

Figure 7:
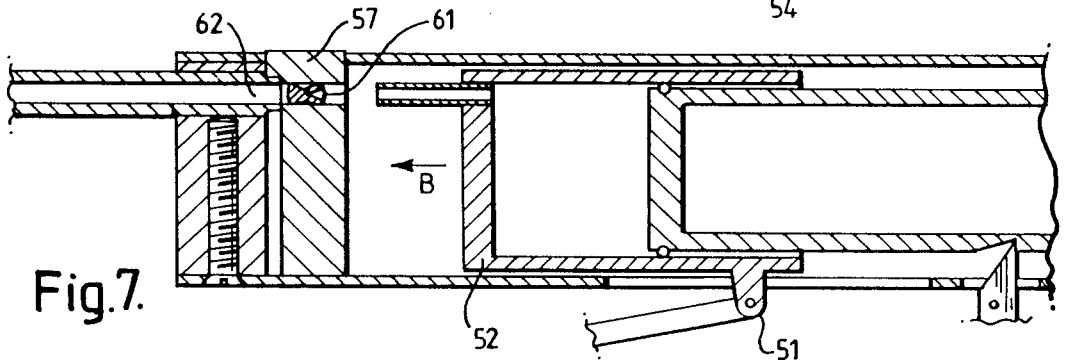

FIG. 7 shows the magazine 57 in place, with a pellet 61 lined up with the breech 62. The cocking lever (not shown) attached to the stud 51 is in the process of being brought forward and the compression cylinder 52 is moving in the direction of arrow B and is shown halfway towards the firing position.

Figure 8:
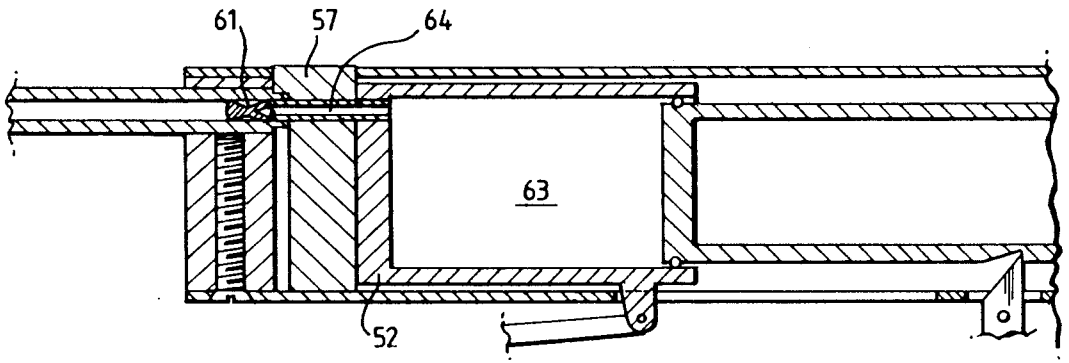

In FIG. 8, the compression cylinder 52 is fully forward, leaving compression chamber 63 fully open and a hollow combination probe and transfer port 64, mounted in the end cap of compression cylinder 52, has passed through magazine 57 and pushed the pellet 61 into the barrel. The probe 64 will seal the breech 62, for example, either by close fitting or by using an "O"-ring on either the probe or in the breech. In a preferred arrangement, the forward end of the probe 64 and the mouth of the breech 62 are correspondingly chamfered to provide interengaging surfaces that seal in a gas-tight manner when the probe 64 is in its forward position. The rifle is now ready to be fired.

Figure 9:
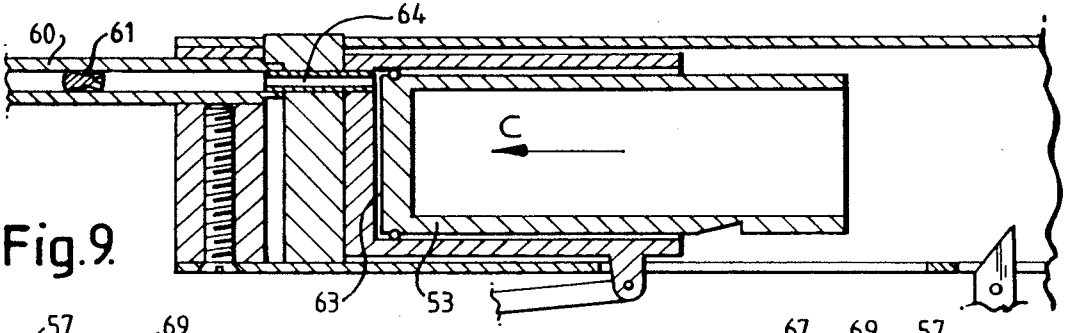

In FIG. 9, the rifle has just been fired and the pellet 61 is in transit through the barrel 60. The piston 53 has moved very rapidly in the direction of arrow C, compressing the air in compression chamber 63 and forcing it through the probe/transfer port 64 and down the barrel, pushing the pellet 61 ahead of it.

When the rifle is next cocked, the compression cylinder 52 will be forced back, carrying the piston 53 with it and compressing the spring 50. The probe 64 is also connected to the compression cylinder 52 and will therefore be withdrawn from the magazine 57. As soon as it is withdrawn, the spring-loaded pellet carrier 2 in the magazine 57 will be free to rotate and the next pellet will be brought into position, aligned with the breech.

The transfer probe 64 repeatedly places each successive pellet 61 accurately in a predetermined position within the breech 62. Thus, as each pellet is fired from exactly the same position within the bore of the gun, high accuracy can be achieved.

Figure 10:
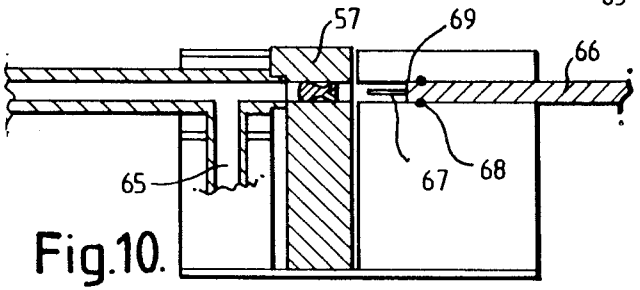
FIGS. 10 and 11 show in section part of an alternative rifle configuration with a magazine in place, going through a loading procedure.
Figure 11:
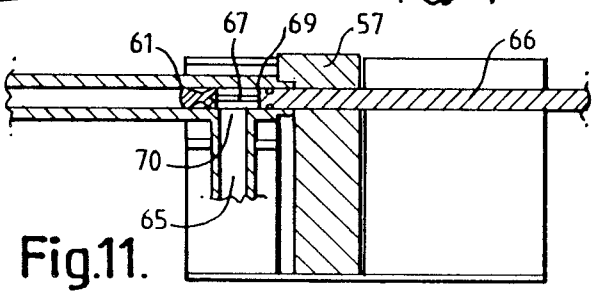

FIGS. 10 and 11 show an alternative air-rifle configuration in which the high-pressure air or gas reaches the breech through a transfer port 65. The power source could be any suitable known system such as a compressible spring or springs running in a cylinder underneath and parallel to the barrel, or a liquid $CO_2$ storage cylinder or a high-pressure, pre-charged air cylinder. In any configuration using high-pressure air or gas, operation of the trigger mechanism will release a metered quantity of the air or gas through the transfer port.

A bolt 66 is solid with a short, small-diameter spigot 67 and is shown with an "O"-ring 68 immediately after shoulder 69 to seal the breech 62 and is shown in its rearward position, which enables the magazine 57 to be inserted or removed.

FIG. 11 shows the bolt 66 pushed forward through the magazine 57, carrying the pellet 61 out of the magazine 57 and far enough into the breech 62 so that the pellet 61 is just past the mouth 70 of the transfer port 65 and the bolt shoulder 69 is just behind the mouth 70. The bolt 66 will be lockable in its forward position by known means. Thus, when the rifle is fired, the high-pressure air or gas will be able to escape out of the mouth 70, flowing past spigot 67, and forcing the pellet 61 down the barrel.

If desired, the bolt 66 may be arranged that it is left unlocked, or locked only for a short period. Then, the arrangement may be such that, when the high pressure air or gas escapes out of the mouth 70, it initially forces the pellet 61 down the barrel and out of the gun but, at the same time, begins to act on the bolt 66 to push it rearwardly out of engagement with the magazine 57—for example, against spring pressure. Thus, as described above in relation to the embodiment of FIGS. 6 to 9, as soon as the bolt 66 is withdrawn from the magazine 57, the pellet carrier 2 may index to present the next pellet in line with the breech 62. Thereafter, the bolt 66 may be again inserted through the magazine 57 to push the next pellet 61 into the breech 62. The bolt 66 may be so actuated either manually, or as part of an automatic mechanism.

In this way, the arrangement shown in FIGS. 10 and 11 may be made to load automatically or semi-automatically, for so long as one or more pellets remains in the magazine 57.

The probe 64 shown in FIGS. 6 to 9 is, as mentioned above, preferably formed with a chamfered front end and a body diameter which is very slightly larger than the pellet diameter, and it is arranged to be in exact registration (that is, exactly co-axial) with the breech 62.

Thus, when the probe 64 is projected forward into the magazine, its chamfered front end firstly engages the walls of the pellet chamber 21 and the abutment face 11 and, as the body of the probe 64 enters the chamber 21, it will be appreciated that this has the effect of causing the pellet carrier 2 to rotate very slightly anti-clockwise (as seen in FIG. 5), thus releasing the grip on the pellet 39 and allowing the probe 64 to push the pellet 39 freely into the breech 62. Of course, it will be appreciated that this sequence of events may take place very rapidly. Whilst retained in the chambers 21, the pellets are maintained substantially parallel to the axis of the breech 62. The mouth of each pellet chamber 21 may be chamfered, to facilitate engagement with the probe 64.

It will be understood that, if there is a small clearance between each pellet 39 and its respective pellet chamber 21, then each pellet is retained in the chamber by co-operation between the pellet carrier 2, the outer case 1 and the cover 3, until such a time as the respective pellet 39 comes to abut against the post 8, to bring it into a position ready for loading.

By way of example for pellets 39 of 5.5 mm nominal calibre, having a maximum diameter of 5.75 mm, each pellet chamber 21 may have a diameter of 6.00 mm. In such an example, the conformity ratio between the pellet 39 and the walls 40 and 41 of the chamber will be about 0.96. Preferably, the conformity ratio between a pellet such as 39 and the walls of a pellet chamber such as 21 is greater than 0.90.

As will be appreciated, whereas the left hand side of the pellet 39 engages the walls of the respective pellet chamber 21 at two areas 40, 41 in the embodiment of FIGS. 1 to 4, the right hand side of the pellet engages only the single abutment surface 11. Therefore, it is particularly advantageous that the conformity ratio at the abutment surface 11 is high. Preferably, it is greater than 0.95, and can reach 1.0 with certain pellets. Of course, if the conformity ratio of the chamber 21 were to be as high as 1.0, or nearly so, then difficulty could be experienced in inserting the pellet 39 into the chamber 21, unless the walls of the chamber 21 were made of a resilient material.

Figure 12:
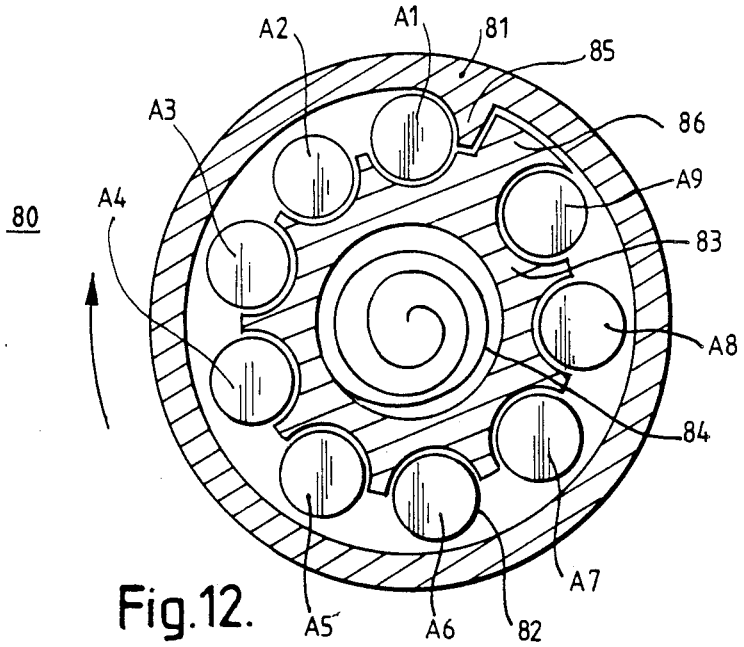
FIG. 12 shows an alternative circular magazine.

FIG. 12 shows, in diagrammatic form, an alternative configuration to that shown in FIGS. 1 to 4.

The magazine 80 that is shown in FIG. 12 comprises an outer casing 81 which is formed with a substantially circular recess 82, in which there is rotatably mounted a rotor 83, resiliently biassed in a clockwise direction by means of a coil spring 84. The outer casing 81 is formed with an inwardly projecting end stop 85. The rotor 83 is formed with a respective end stop 86. A cover (not shown for clarity) with a loading aperture will pivot on a central fixing (also not shown) and may be used to wind up the rotor 83 in a broadly similar manner to the cover 3 in FIGS. 1 and 2.

The rotor is formed with a plurality of substantially semi-circular cut-outs, in each of which a respective airgun pellet A1 to A9 is seated.

As shown diagrammatically in FIG. 12, pellet A1 abuts against the end stop 85 which, as in the embodiment of FIGS. 1 to 4, has a curved abutment face of a diameter corresponding to that of the airgun pellets A1 to A9. A probe mechanism serves to push the airgun pellet A1 out of the magazine and into the breech of a respective airgun, ready for firing. Once the pellet A1 has been pushed out of the magazine 80, then the rotor 83 rotates under the force of the spring 84, to bring the next pellet A2 into abutment with the end stop 85.

The loading and firing procedure may then be repeated, until the last pellet A9 has been loaded, whereupon the rotor end stop 86 comes to abut against the end stop 85 of the outer casing 81.

Thus, it may be appreciated that the illustrated magazine 80 may operate in a manner broadly similar to that of the embodiment shown in FIGS. 1 to 4, although the actual configuration of the magazine components is slightly different.

So far, there have been illustrated and described airgun magazines that are of a substantially circular configuration, and which have a rotary movement of the pellet carrier. This may be a preferred configuration, as it lends itself well to a compact construction and may blend in to the exterior shape of an airgun in which the magazine is mounted.

However, it is possible to provide magazines of a different configuration. For example, FIG. 13 is a simplified illustration of a straight magazine.

Figure 13:
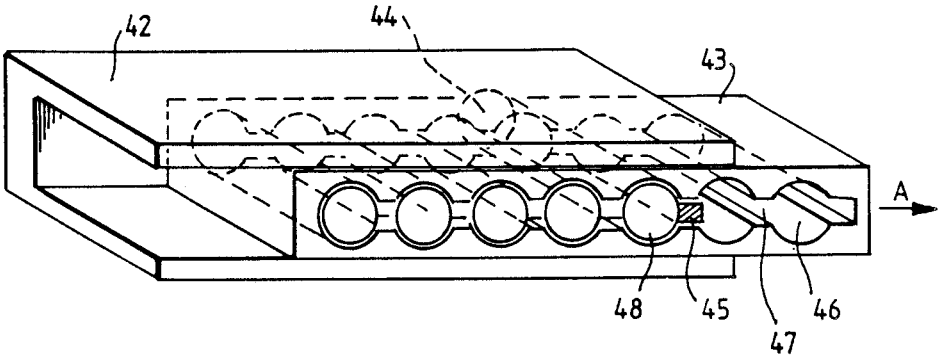
FIG. 13 shows an alternative straight magazine, in simplified form.

In FIG. 13, only an outer case 42 and a pellet carrier 43 are shown, for convenience. The case 42 is formed with a channel and with a pellet exit hole 44 and, aligned with the edge of the exit hole 44, a pellet stop post 45. The carrier 43 is a rectangular strip having a series of pellet chambers 46 interconnected via a straight channel 47, which is just wide and long enough to clear the stop post 45. The carrier 43 is spring loaded to move in the direction of arrow A, relative to the case 42.

As shown in FIG. 13, pellet 48 will be the next pellet to be fired and, when it has gone, spring pressure will move the carrier 43 in the direction of arrow A until the post 45 comes into contact with the next pellet. Further details such as cover plate, spring, fastening means, registering means between the magazine and breech and other details have been omitted, for clarity. Nevertheless, it may be appreciated that the straight magazine as illustrated in FIG. 13 may operate in a manner analogous to that shown in FIGS. 1 to 4. Therefore, a more detailed description of an example of operation of the straight magazine of FIG. 13 will not be required.

Figure 14A:
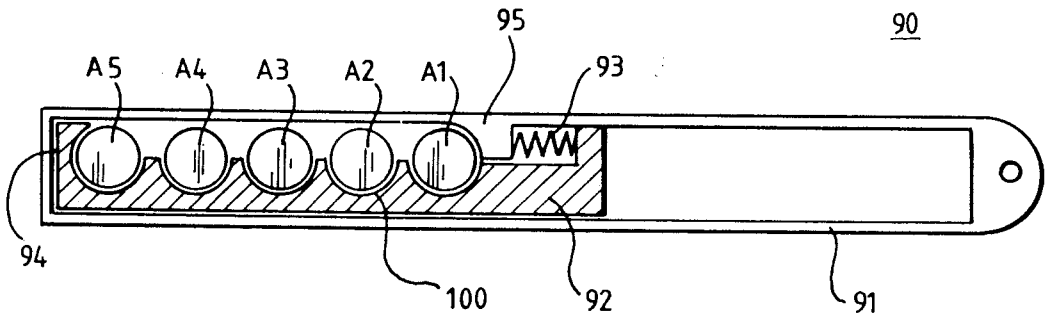
FIGS. 14 to 16 show further respective examples of straight magazines.
Figure 14B:
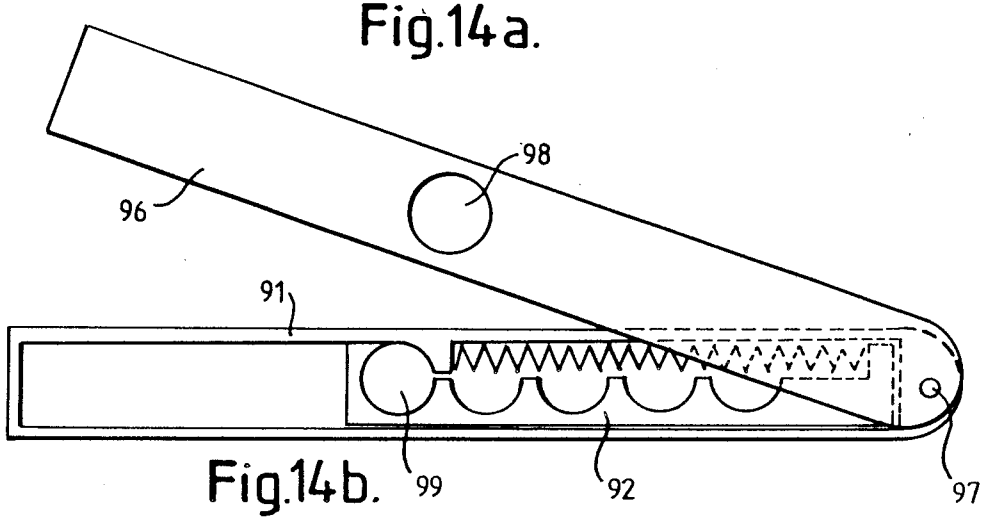

FIGS. 14A and 14B show another example of a straight magazine 90.

In FIG. 14A, a pellet carrier 92 is slideably mounted within an outer casing 91, and is resiliently biassed to the right (as seen) by means of a spring 93. The pellet carrier 92 is formed with five substantially semi-circular cut-outs 100, each of which is adapted to seat a respective airgun pellet A1 to A5. At one end of the pellet carrier 92 there is formed an end stop 94. The outer casing 91 is formed with an end stop 95, having a curved abutment surface.

As shown in FIG. 14B, the outer casing 91 is provided with a cover plate 96, which may pivot about a pivot point 97.

In use, the cover plate 96 is pivoted out of its closed position, to afford access to the inside of the magazine 90. The pellet carrier 92 is then moved manually to the leftmost position (as seen) and, keeping a finger over an outlet hole 99 of the outer casing 91, a first pellet is dropped into the position A1 shown in FIG. 14A. Then, upon releasing the pellet carrier 92, the spring force urges the pellet A1 against the curved abutment surface of the end stop 95, to lock the pellet carrier in position, in a manner analogous to that of the circular magazine of FIGS. 1 to 4. Thereafter, the remaining four pellets can simply be dropped into the A2 to A5 positions.

The cover plate 96 is then pivoted to its closed position, placing a probe hole 98 in register both with the breech of a respective airgun and the pellet exit hole 99 in the outer casing. It will of course be appreciated that the exit hole 99 is substantially in line with the A1 pellet position.

Thereafter, as a probe passes through the magazine to load the A1 pellet, the A2 pellet then comes into the ready position, and so on, until all of the pellets A1 to A5 have been used up.

Again, having regard to the detailed description given above with regard to the circular magazine, the analogous operation of the embodiment of FIGS. 14A and 14B will readily be understood by the skilled reader, and therefore need not be repeated.

Whereas, in the embodiment of FIG. 13, the magazine would tend to "grow" in length as the pellets are used up, it will be appreciated that, in the FIG. 14 embodiment, the length of the magazine always remains constant. The FIG. 14 embodiment may also have the advantage that all of the moving parts may be substantially protected from snagging and the ingress of dirt. On the other hand, embodiments of the FIG. 13 type which "grow" as the pellets are use up may have the advantage of allowing the user to monitor the number of pellets remaining in the magazine very readily indeed.

Figure 15:
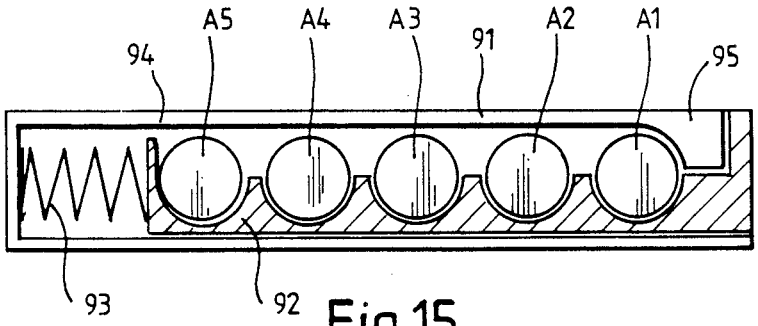
Figure 16:
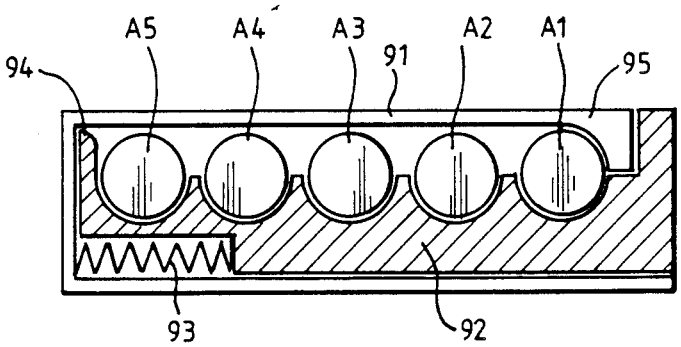

FIGS. 15 and 16 illustrate yet alternative configurations of straight magazines, each of which "grows" in length as the pellets are used up. The embodiment of FIGS. 15 and 16 comprise parts which are substantially similar to those of the embodiment of FIG. 14, although the configurations of the springs 93 are different and the cover plate (not shown for clarity) could be fixed permanently in position with its loading hole over pellet A1.

It will be appreciated that, when the magazine of the FIGS. 15 or 16 embodiment is empty, the pellet carrier 92 will be fully extended to the right and the pellet recess shown holding pellet A5 will be the nearest recess to the loading and exit holes. Clearly, recess A5 will not line up exactly with the holes when it has no pellet in it since it must be able to provide some gripping force to the pellet and will therefore be able to move slightly further to the right when pellet A5 has been used.

The loading procedure for magazine embodiments similar to FIGS. 15 and 16 would be as follows. The user would hold the magazine with the loading hole facing upwards and a finger over the exit hole. Slight pressure will then be applied to the pellet carrier 92 at D to move the carrier slightly to the left and thus create sufficient space between the A5 recess and abutment surface of the end stop 95 to allow pellet A5 to be dropped in. Further pressure at D will bring recess A4 in line with the loading and exit holes and allow pellet A4 to be dropped in. This process will be repeated until the last pellet A1 is also dropped in. Pressure at point D can then be relaxed and pellet A1 will be gently gripped between the carrier 92 and the end stop 95 by spring pressure. Until then a finger must be kept over the exit hole to avoid the pellets simply dropping straight through the magazine as they are located.

Alternatively, a pivotable (or slideable) cover plate may be provided, similar to the cover plate 96 of FIG. 14, to allow the magazines of FIGS. 15 and 16 to be loaded in a manner similar to that of the magazine of FIG. 14.

It will be noted that, in the embodiments of FIGS. 15 and 16, the end stops 94 of the pellet carriers 92 are shaped to conform substantially to the curved abutment surface of the end stops 95 on the casings 91. Thus, when the last pellet A5 has been loaded, the respective end stops 94 comes to abut closely against the corresponding curved surface of the end stops 95, to provide a firm abutment with negligible risk of jamming.

The end stop 94 of the pellet carrier 92 shown in the FIG. 14 embodiment may be formed in the same way as the embodiments of FIGS. 15 and 16. Alternatively or additionally, the arrangement of the FIG. 14 embodiment may be such that, after the last pellet A5 has been loaded into the gun, the right hand end wall of the pellet carrier 92 (as seen in FIG. 14) comes to abut against the corresponding inner end wall of the casing 91, thereby defining an end position of the pellet carrier 92.

Thus, the illustrated embodiments may provide simple and extremely reliable magazines for use with airguns, which can be loaded with either or both ball or diabolo pellets of a calibre to suit the airgun and may be insensitive to the shape or length of the pellets. They may ensure that pellets may be fed directly into the breech and engaged in the rifling without distortion or damage. They may be extremely compact and easily removed or inserted. The magazines may be carried safely and reliably in the pocket, whilst being fully loaded. They may enable a user to ascertain rapidly whether any pellets are left, without removing the magazine from a respective gun.

The above described and illustrated embodiments may be used in almost any sort of air pistol or air rifle, and need not be limited to fixed barrel airguns or to those using a compressible power source behind the barrel. Although, to follow convention, reference is made in the specification to "air" guns, it is to be understood that alternative compressible gas propulsion systems may be employed.

A particularly preferred feature of the illustrated embodiments is that they use the airgun pellets themselves as part of the indexing mechanism. That is, the indexing mechanism depends upon there being a pellet in the magazine, and the "next" pellet to be fired actually serves as part of the abutment means to place the pellet in register with the breech.

However, the invention, as broadly claimed, may extend also to magazines which have seperate indexing mechanisms that do not employ the pellets themselves directly.

The components of the magazine may be made of synthetic plastics materials, of metal, or other suitable materials.

The reader's attention is directed to all papers and documents which are filed concurrently with or previous to this specification and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. An airgun magazine comprising:

a pellet carrier having a plurality of chambers each for receiving a respective airgun pellet;

a housing in which the pellet carrier is movably mounted;

a cover which co-operates with the pellet carrier and the housing to retain pellets in respective ones of the pellet chambers; and means for causing movement of the pellet carrier in the housing to present successive pellets in the pellet chambers to the breech of an airgun when the pellet carrier is fitted in the airgun:

wherein the magazine is adapted to be detachable as a complete exchangeable unit from an airgun in which the magazine may be used, the arrangement being such that, when the magazine is so removed, the pellet chambers may be loaded with pellets which are then retained in respective ones of the pellet chambers by co-operation between the pellet carrier, housing and cover.

2. A magazine according to claim 1, wherein said housing is provided with registration means adapted to co-operate with corresponding registration means provided on an airgun to ensure consistent registration of the magazine with the breech of the airgun when the magazine is fitted in the airgun.

3. A magazine according to claim 1, wherein each pellet chamber is of at least part-cylindrical configuration.

4. A magazine according to claim 1, wherein said cover is moveable with respect to the housing and/or pellet carrier, so that the cover may be placed into successive positions to permit loading of successive ones of the pellet chambers.

5. A magazine according to claim 1, including indexing means for so controlling movement of the pellet carrier in the housing as to ensure registration of the successive pellet chambers with the breech of the airgun, in use, the indexing means including an abutment surface which is arranged to abut each successive pellet in the pellet carrier so as to ensure registration of that pellet with the breech of the airgun.

6. A magazine according to claim 5, wherein, when said abutment surface abuts a respective one of the pellets, the pellet reacts the force applied at the abutment surface at at least two points on the pellet carrier.

7. A magazine according to claim 6, wherein the abutment surface is provided on a projection which extends into the pellet carrier and the pellet carrier is provided with a slot which extends through the pellet chambers and which passes around said projection as the pellet carrier moves relative to the housing.

8. A magazine according to claim 7, wherein said projection is provided on said housing.

9. A magazine according to claim 5, wherein said abutment surface is of a part-circular configuration of a radius substantially corresponding to that of the pellets to be received in the magazine.

10. A magazine according to claim 5, wherein each pellet chamber has a diameter slightly greater than that of the pellets with which the magazine is intended to be used, the arrangement being such that the pellet that is in a position ready to be loaded into the breech is retained in its chamber at least partly by abutment with said abutment surface, and each other pellet is retained in its chamber by co-operation between the pellet carrier and housing or by co-operation between the pellet carrier, housing and cover.

11. A magazine according to claim 1, including resilient biassing means for biassing the pellet carrier towards an end position within said housing.

12. A magazine according to claim 1, wherein the pellet carrier is of a circular configuration, arranged for angular movement within said housing.

13. A magazine according to claim 1, wherein the pellet carrier is of a straight configuration, arranged for rectilinear movement within said housing.

14. A magazine according to claim 1, wherein said housing is provided with an exit hole which in use registers with the breech of the airgun, and through which pellets are passed from the pellet carrier and into the breech.

15. An airgun provided with a magazine according to claim 1.

16. An airgun according to claim 15, further comprising:

means for presenting pellets in the magazine successively adjacent the breech of the airgun; and transfer means for transferring into the breech each pellet that is presented adjacent the breech, the transfer means comprising a probe that is arranged to extend through the magazine to push the respective pellet out of the magazine and into a predetermined position within the breech.

17. An airgun according to claim 16, wherein a forward end of the probe co-operates with the mouth of the breech to provide a gas-tight seal when the probe places a pellet in said predetermined position within said breech.

18. An airgun according to claim 17, wherein said forward end of the probe and the mouth of the breech are correspondingly chamfered to provide interengaging surfaces which provide said gas-tight seal.

19. An airgun according to claim 16, wherein the magazine is arranged to grip at least the pellet that is presented adjacent the breech, and the probe is arranged to release said grip as it extends through the magazine to push the pellet into the breech.

20. An airgun according to claim 19, wherein the probe is arranged to release said grip by co-operating with the pellet carrier to move the pellet carrier by a small amount, as the probe extends through the magazine.

21. An airgun according to claim 16, wherein the probe is arranged to be withdrawn automatically through the magazine after firing of the airgun, thereby to cause or permit the magazine to index to present the next pellet adjacent the breech.

22. An airgun according to claim 21, wherein the probe is arranged to be extended automatically through the magazine each time the magazine has been indexed, so as to push the next pellet into the breech.

23. An airgun according to claim 16, wherein the probe is hollow to define an air passage through which, in use, air passes to propel a pellet out of the gun.

24. A magazine according to claim 1, wherein said cover is provided with at least one loading aperture through which pellets may be loaded into the pellet chambers.

25. An airgun magazine comprising:

a pellet carrier having a plurality of chambers each for receiving a respective airgun pellet;

a housing in which the pellet carrier is moveably mounted;

means for causing movement of the pellet carrier in the housing to present successive pellets in the pellet chambers to the breech of an airgun when the pellet carrier is fitted in the airgun; and indexing means for so controlling movement of the pellet carrier in the housing as to ensure registration of the successive pellet chambers with the breech of the airgun, in use, the indexing means including an abutment surface which is arranged to abut each successive pellet in the pellet carrier so as to ensure registration of that pellet with the breech of the airgun, the abutment surface being provided on a projection which extends into the pellet carrier, the pellet carrier being provided with a slot which extends through the pellet chambers and which passes around said projection as the pellet carrier moves relative to the housing, and the arrangement being such that, when said abutment surface abuts a respective one of the pellets, the pellet reacts the force applied at the abutment surface at at least two points on the pellet carrier.

26. A magazine according to claim 25, wherein said abutment surface is of a part-circular configuration of a radius substantially corresponding to that of the pellets to be received in the magazine.

27. A magazine according to claim 25, wherein said projection is provided on said housing.

* * * * *